US011657737B2

(12) United States Patent
O'Kell et al.

(10) Patent No.: US 11,657,737 B2
(45) Date of Patent: May 23, 2023

(54) PHOTOLUMINESCENT SIGNS

(71) Applicant: Saf-T-Glo Limited, Wales (GB)

(72) Inventors: Sean Patrick O'Kell, Cwmbran (GB); Andrew Jon Hallett, Cwmbran (GB)

(73) Assignee: SAF-T-GLO LIMITED, Cwmbran (GB)

( * ) Notice: Subject to any disclaimer, the term of this patent is extended or adjusted under 35 U.S.C. 154(b) by 0 days.

(21) Appl. No.: 17/553,426

(22) Filed: Dec. 16, 2021

(65) Prior Publication Data

US 2022/0198970 A1 Jun. 23, 2022

(30) Foreign Application Priority Data

Dec. 17, 2020 (GB) ..... 2020055

(51) Int. Cl.
*G09F 13/22* (2006.01)
*G09F 13/10* (2006.01)

(52) U.S. Cl.
CPC ..... *G09F 13/22* (2013.01); *G09F 13/10* (2013.01)

(58) Field of Classification Search
CPC ..... G09F 13/22; G09F 13/20; G09F 13/10
USPC ..... 40/580
See application file for complete search history.

(56) References Cited

U.S. PATENT DOCUMENTS 4,420,898 A * 12/1983 Moses ..... G08B 7/062 40/544
8,540,831 B1 * 9/2013 Cole ..... G09F 3/02 156/67
2002/0108283 A1 * 8/2002 Suen ..... G09F 19/22 40/542
2003/0129297 A1 * 7/2003 Jakobi ..... H05B 33/12 296/193.11
2004/0055483 A1 * 3/2004 Thollin ..... G09F 13/20 101/35
2005/0102871 A1 * 5/2005 Merle ..... G09F 13/20 40/542
2005/0198879 A1 * 9/2005 Hannington ..... G09F 13/20 40/542

(Continued)

FOREIGN PATENT DOCUMENTS

EP 1 783 000 A1 5/2007
GB 2 512 498 A 10/2014

(Continued)

OTHER PUBLICATIONS

UK Search Report on GB Appl. Ser. No. 2118102.9 dated Apr. 12, 2022 (3 pages).

(Continued)

*Primary Examiner* — Gary C Hoge
(74) *Attorney, Agent, or Firm* — Foley & Lardner LLP

(57) ABSTRACT

An aircraft emergency sign comprising a base layer comprising a photoluminescent material arranged to be charged by electromagnetic wavelengths in a first range and arranged to emit electromagnetic emissions in a second range; a barrier layer; and a print layer, the print layer being printed with at least one of a color or a pattern wherein the print layer is above the barrier layer and on a side remote from the base layer, and wherein the print layer is at least semi-transparent to wavelengths in the first range and the second range, the sign further comprising a mask layer provided between the barrier layer and the print layer.

15 Claims, 4 Drawing Sheets

(56) References Cited

U.S. PATENT DOCUMENTS

| | | | | |
|---|---|---|---|---|
| 2007/0240346 | A1* | 10/2007 | Li | G09F 13/22 40/544 |
| 2010/0018092 | A1* | 1/2010 | Peckham | G09F 13/20 40/542 |
| 2011/0119972 | A1* | 5/2011 | Kay | G09F 13/20 40/541 |
| 2012/0227296 | A1* | 9/2012 | Roberts | G09F 19/22 40/542 |
| 2013/0145693 | A1* | 6/2013 | Li | G09F 13/04 49/70 |
| 2013/0162831 | A1* | 6/2013 | Roth | G08B 7/062 348/151 |
| 2013/0199064 | A1* | 8/2013 | O'Kell | G09F 13/42 40/542 |
| 2018/0257791 | A1* | 9/2018 | Sutter | B60Q 3/46 |
| 2020/0308439 | A1* | 10/2020 | O'Kell | B41J 11/00214 |
| 2021/0118340 | A1* | 4/2021 | Hyman | G09F 3/14 |

FOREIGN PATENT DOCUMENTS

| | | | |
|---|---|---|---|
| GB | 2 545 094 | A | 6/2017 |
| JP | 2012-118123 | A | 6/2012 |
| WO | WO-2007/039673 | A1 | 4/2007 |
| WO | WO-2011/046642 | A1 | 4/2011 |

OTHER PUBLICATIONS

UK Search Report on GB Appl. Ser. No. 2020055.6 dated May 17, 2021 (2 pages).

* cited by examiner

PHOTOLUMINESCENT SIGNS

CROSS-REFERENCE TO RELATED PATENT APPLICATIONS

The present application claims the benefit of and priority to United Kingdom Patent Application GB2020055.6, filed Dec. 17, 2020, the entire disclosure of which, including the specification, drawings, claims and abstract, is incorporated herein by reference.

BACKGROUND

The present application relates to photoluminescent signs. The concepts disclosed herein have particular but not exclusive application to signs used in transport vehicles such a ships aircraft, buses, trains and the like to identify an exit and/or to indicate a path or route to an exit or to provide emergency information. Such signs may be used to assist people escape from vehicles and the like in an emergency situation. It will be appreciated that the signs may also be used in buildings or in other locations where emergency signage is needed. Such signs may be provided at or near to an exit so as to assist in identifying the exit. Such signs may also be provided as part of an escape system configured to guide people towards and to identify an exit.

It is known to provide signs with electrical lighting to enable them to be more readily visible. In an emergency, electrical power may be lost and an emergency signs relying on electrical lighting then lack illumination and may not be visible. In passenger vehicles in particular, it is important to provide signs that are visible even in the case of a loss of electrical power. This is of particular importance in passenger transport vehicles such as aircraft and ships.

In aircraft in particular, there are typically safety regulations and requirements. The safety regulations may specify that a back-up power system may be provided, and this may comprise a battery powered lighting system. Safety requirements specify that the battery in a back-up system must supply power to the light systems for at least ten minutes. However, it is also known that it may take more than 10 minutes to evacuate a cabin and if the battery fails before evacuation is completed remaining passengers and personnel may have difficulty in locating the exit. In addition, if an aircraft or other vehicle is broken up then the lighting system circuits may be broken and the electrical lighting may fail completely.

It has been known to use photoluminescent signs and markers in passenger transport vehicles such as ships and particularly in aircraft. Photoluminescent markers and signs comprise photoluminescent material. When exposed to a light source, the photoluminescent material is activated and provides a low level light source that is normally invisible in daylight but is visible under conditions of darkness or low illumination from other light sources, for example where smoke from a fire blocks the overhead lights that normally illuminate the passenger cabin. The level of illumination provided by the photoluminescent material under these conditions is sufficient to guide passengers to an exit to evacuate aircraft and eliminates the problems associated with electrical powered systems that are prone to failure at the time that they are required.

Commonly, photoluminescent material has a pale yellow color. The typical colors of photoluminescent material tend to be highly visible even under normal ambient lighting conditions. In some situations, it may be undesirable to have a sign that is highly visible under normal ambient lighting conditions. Some passengers do not like seeing safety equipment or safety information, as it can raise awareness of apparent risks and cause a sense of disquiet or unease. Consequently, the presence of visible safety signs may have a detrimental effect on a passenger experience in an aircraft. In addition, the presence of obvious emergency signs in an aircraft can also detract from an aesthetic appearance of a cabin environment.

SUMMARY OF THE INVENTION

According to an exemplary embodiment, an aircraft has a cabin including at least one emergency sign. The emergency sign includes a base layer including a photoluminescent material arranged to be charged by electromagnetic wavelengths in a first range and arranged to emit electromagnetic emissions in a second range, a barrier layer, and a print layer. The print layer is printed with at least one of a color or a pattern and wherein the print layer is above the barrier layer and on a side remote from the base layer, and the print layer is at least semi-transparent to wavelengths in the first range and the second range. The emergency sign further includes a mask layer provided between the barrier layer and the print layer.

According to another exemplary embodiment, an aircraft emergency sign includes a base layer including a photoluminescent material arranged to be charged by electromagnetic wavelengths in a first range and arranged to emit electromagnetic emissions in a second range, a barrier layer, and a print layer. The print layer is printed with at least one of a color or a pattern and wherein the print layer is above the barrier layer and on a side remote from the base layer, and the print layer is at least semi-transparent to wavelengths in the first range and the second range. The emergency sign further includes a mask layer provided between the barrier layer and the print layer.

BRIEF DESCRIPTION OF THE DRAWINGS

The invention will now be further described by way of example only with reference to the accompanying Figures in which.

DETAILED DESCRIPTION

Figure 1:
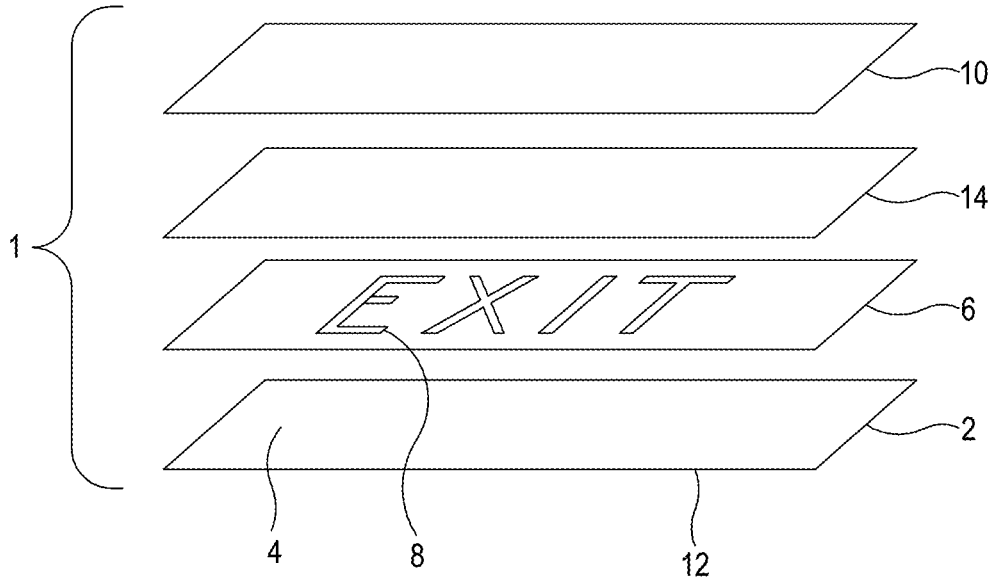
FIG. 1 is exploded view of the structure of a sign in accordance with an exemplary embodiment.

According to an exemplary embodiment, there is provided an aircraft emergency sign.

The emergency sign comprises a plurality of layers, the plurality of layers comprising a base layer comprising a photoluminescent material arranged to be charged by electromagnetic wavelengths in a first range and arranged to emit electromagnetic emissions in a second range; a barrier layer; and a print layer, wherein the print layer is above the barrier layer and on a side remote from the base layer, and wherein the print layer is at least semi-transparent to wavelengths in the first range and the second range.

In some embodiments, the barrier layer is dark. In some embodiments the barrier layer may be black. The barrier layer is adapted and arranged such that at least a portion of the layer prevents light, such as visible light or light emitted by the photoluminescent material, in the second range, from passing through that portion of the layer. In some embodiments, the barrier layer is typically provided with apertures forming words or graphics or images which may be referred to as text or symbology. Photoluminescent light can pass through the apertures. The barrier layer may comprise a film layer. The barrier layer may comprise a colored film. In other embodiments the barrier layer may comprise a film having a color printed on at least one side of the film. The color printed on the film may be opaque or at least substantially opaque to light emitted from the photoluminescent material. In a particular embodiment, a dark color printed on the film may comprise unprinted areas through which emitted light may pass. In other embodiments, the barrier layer may comprise printed words or symbology forming a barrier to emitted light. The remainder of the barrier layer may be arranged to allow emitted light to pass so that the words or symbology are formed in negative. The text or symbology may be formed by apertures in the film.

In some exemplary embodiments, the text or symbology is formed by the printing a dark color directly onto the photoluminescent material, either as a positive or negative image. In some embodiments the barrier layer may form a negative image of the desired words, graphics or images by having the text or symbology printed as the barrier layer over at least a portion of the photoluminescent material such that photoluminescent light cannot pass through the printing forming the barrier layer.

It has been found that providing a printed layer over the barrier layer does not provide a satisfactory appearance in ambient light. In prior art solutions, it has been found that the presence of emergency signage is visible in normal ambient lighting. At least in part, this is believed to arise from a contrast between dark areas of the barrier layer through which emitted photoluminescent light cannot pass and lighter areas where an aperture in the film or in the print allows light from the photoluminescent material to pass.

In some embodiments, a mask layer is provided between the barrier layer and the print layer. The mask layer may comprise a film. The mask layer film may comprise a colored film. According to an exemplary embodiment, the mask layer may comprise a film on which a coating of ink has been printed. According to some exemplary embodiments, the mask layer comprises a layer of ink or other pigment printed over or applied over the barrier layer. The mask layer may be printed over all of the sign. The mask layer may be printed over the dark portions and over the apertures or unprinted portions of the barrier layer in order to provide a background for the print layer.

The applicant has found that providing a mask layer improves the appearance of the printed layer. The mask layer may comprise a neutral color. In some embodiments the mask layer has a homogenous color. Desirably a color of the mask layer is selected to provide an even background to the printed layer. The mask layer may be arranged to at least partially obscure the barrier layer and to provide an even background to the print layer. Typically, the mask layer may be a light color or hue or may be another neutral color and, according to some exemplary embodiments, is homogenous. The mask layer may be white in some embodiments.

It has been found that the mask layer provides an even and homogenous background to the print layer and so obscures the image of the text or symbology in the barrier layer when the sign is viewed in ambient lighting conditions.

It is desirable that the mask layer is transparent or at least partially transparent, to wavelengths in the first range and in the second range. The first range allows wavelengths that are absorbed by the photoluminescent material to charge the photoluminescent materials. The second range allows emitted wavelengths to pass through the further layer. The first range may be UV to blue light wavelengths. The second range of emitted light is typically in the blue to green range of wavelengths. According to an exemplary embodiment, the second range is visible light. The barrier layer may in some embodiments be at least partially transparent to electromagnetic radiation in the first range.

The sign may have a surface area. Desirably, the mask layer is provided over substantially all of the surface area of the sign.

In some embodiments, the sign may be utilized in a cabin in an aircraft. The sign may be adapted to be secured to a wall in the cabin. In other embodiments, the sign may be adapted to be secured to a fitting in the cabin of the aircraft. The wall of the aircraft may have a color or a pattern. In some embodiments the wall or fitting may comprise a pattern such as a wood effect.

Desirably, the print layer is printed with at least one of a color or a pattern. The print layer may comprise a color. The color of the print layer may be selected to match a surface area on a surface of the aircraft cabin on which the sign may be mounted in use. In some embodiments, the sign may be mounted on a wall and the color selected matches the color of the wall. In other embodiments, the sign has a print layer having a pattern printed thereon. The printed pattern may be selected or arranged to match the surface of the surrounding area.

Desirably, the sign is provided with a protective layer. The protective layer may be arranged to cover at least part of the print layer. The protective layer is desirably arranged to cover substantially the entire print layer.

Desirably, the photoluminescent material exhibits persistent luminescence. In some embodiments, the photoluminescent material comprises a strontium aluminate. The photoluminescent material may be selected from blue emitting $Sr_4Al_{14}O_{25}Eu$, Dy and green emitting $SrAlO_4Eu$, Dy. Typically, the photoluminescent material is excited, or charged, by electromagnetic wavelengths in the first range. The excitation wavelengths in the first range may be from 250 nm to 470 nm. In some embodiments the photoluminescent material may be excited by wavelengths in the range from 400 nm to 470 nm.

In some embodiments, the photoluminescent material emits electromagnetic wavelengths in the range from 400 to 800 nm. The second range may be from 400 nm to 600 nm or from 450 nm to 500 nm or substantially at 490 mm. In other embodiments, the second range may be from 450 nm to 700 nm or from 500 nm to 600 nm or more preferably from 500 nm to 550 nm or from 500 nm to 540 nm or substantially at 520 nm. In an exemplary embodiment, the wavelengths emitted in the second range are in the visible light range.

As described above, a barrier layer may be provided adjacent to the base photoluminescent layer and between the base layer and the print layer. The barrier layer may comprise symbology or words in positive or negative form. Where the symbology or words are provided in positive form in the barrier layer, the symbology or wording will appear as a dark area on an illuminated background in the sign in a low light level scenario. Where the symbology or words are provided in negative form in the mask, the symbology or wording will appear as an illuminated area on a dark background in the sign in a low light level scenario.

An important aspect of some embodiments is that in a low ambient light scenario, light emission from the photoluminescent material passes through the apertures in the barrier layer, where words or symbology are provided or vice versa, the mask layer and the print layer and the emergency signage or symbols are visible to the passengers and crew of the vehicle. Typically a low light scenario is one in which normal electric lighting in the vehicle has failed.

In a normal lighting scenario, the ambient light is reflected by the print layer which matches that of a surrounding surface of a wall or fitting on which the sign is mounted. The intensity of emissions from the photoluminescent material is relatively much lower than the reflected light, and so the photoluminescent light emitted is not perceived by passengers or crew. Consequently the sign is perceived as being a part of the surrounding surface, and the symbology or words in the barrier layer are not visible to passenger or crew in a normal ambient light scenario.

It will be appreciated that as the ambient light levels decrease the light emission from the photoluminescent material becomes more visible. It will also be appreciated that the emergency sign provides luminance but not illuminance. Providing luminance means that the sign can be seen. In contrast illuminance means that a surrounding area is lit up. In providing luminance but not illuminance the sign may be used to provide emergency guidance but without disturbing passengers who may be sleeping. In addition it will be appreciated that the color of the emitted light from the photoluminescent material may be important. In low levels of light the human eye uses scotopic vision in which the eye uses rods to detect light. Scotopic vision is particularly sensitive to light emitted in the blue wavelengths from 450 nm to 500 nm. In scotopic vision the eye perceives light and dark. In scotopic vision the eye does not perceive color. Accordingly if the signs emit light having wavelengths in this region from 450 to 500 nm then the sign will be able to provide sufficient luminance at lower levels of light output. In high light levels the human eye uses photopic vision which uses cones in the retina to detect objects and color. In medium light levels the human eye uses mesopic vision which is a combination of photopic and mesopic vision.

As a result, the emergency sign emitting in the range 450 nm to 500 nm is not visible in normal operating light level conditions but becomes visible in an emergency scenario in which electrical lighting has failed or is obscured. Safety requirements for providing guidance to passengers and crew are met by the sign in an emergency scenario but passenger experience is not reduced by the visibility of emergency signage in normal use. Additionally the aesthetic appearance of a cabin is not reduced by the intrusion of emergency signage in normal use, but safety requirements are met in the event of an emergency.

According to another exemplary embodiment, there is provided an aircraft comprising a cabin having at least one sign in accordance with the embodiments described above.

It will be appreciated that the cabin may have a wall and the sign may be mounted in a portion of the wall. In other embodiments, the cabin may be provided with a fitting and the sign may be mounted in a portion of the fitting in the cabin. The portion of the wall or the fitting may have a surface having a color or a pattern. Desirably the print layer of the sign has a pattern matching the surface of the portion of the wall or fitting on which the sign in mounted. The color may be a plain color. In some embodiments the portion of the wall or fitting has a pattern such as a wood effect. The pattern on the print layer may be arranged to have the same pattern as the pattern on the portion of the wall or fitting on which the sign is mounted.

As best illustrated in FIG. 1 there is provided an emergency sign 1 comprising a plurality of layers. The emergency sign comprises a base layer 2. The base layer 2 comprises a photoluminescent material 4 arranged to be charged by electromagnetic wavelengths in a first range and arranged to emit electromagnetic emissions in a second range. A barrier layer 6 is provided adjacent to the base photoluminescent layer 2. The barrier layer 6 has informational text or symbology 8. A print layer 10 is provided above the barrier layer 6 and on a side of the barrier layer 6 remote from the photoluminescent base layer 2. The print layer 10 is at least semi-transparent to wavelengths in the first range and the second range.

The base layer 2 comprises photoluminescent material 4. The photoluminescent material 4 can be provided on a substrate 12. In some embodiments the photoluminescent material 4 may be provided as a suspension of photoluminescent pigments in a resin.

Figure 3:
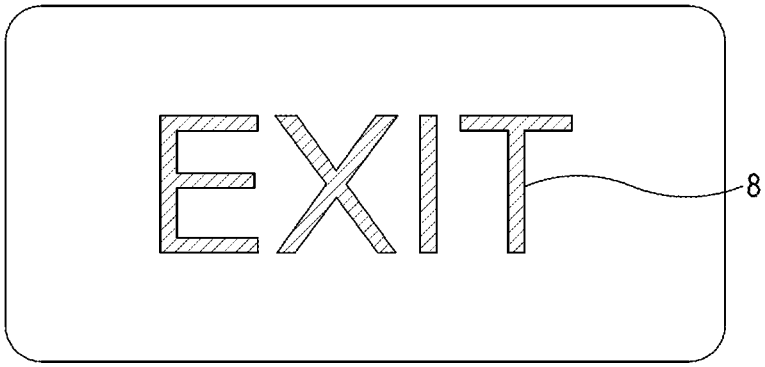
FIG. 3 is a view of the sign of FIG. 1 in dark conditions, in accordance with an exemplary embodiment.
Figure 4:
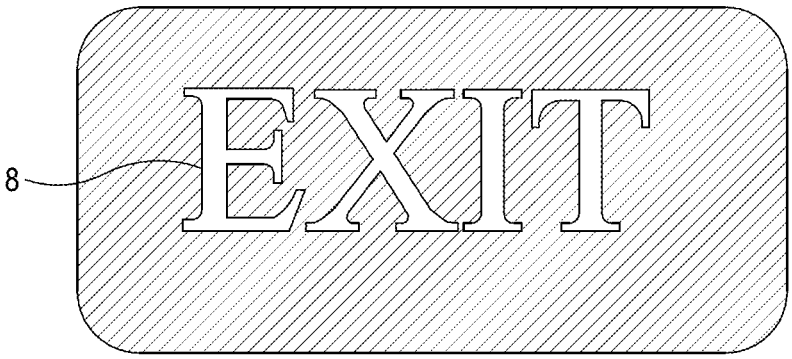
FIG. 4 is a view of an alternative embodiment of the sign.

The barrier layer 6 is provided adjacent to the photoluminescent base layer 2 and between the base layer 2 and the print layer 10. The barrier layer 6 can be a film. As an alternative the barrier layer may be printed directly onto the photoluminescent layer. The barrier layer 6 is desirably at least partially opaque to at least electromagnetic emissions in the second range. It is preferred that the barrier layer is substantially opaque to at least electromagnetic emissions in the second range. In some embodiments the barrier layer may comprise a colored film such as a black film. In some embodiments the barrier layer may comprise a film, clear or colored, on which a dark or black ink has been printed. The barrier layer 6 may comprise symbology or words in positive or negative form. In preferred embodiments the symbology or words can be printed onto a barrier film or more preferably in other embodiments printed directly onto the photoluminescent material. Symbology or words may be wording such as EXIT or arrows to indicate direction or other symbols such as a running man. Where the symbology or words 8 are provided in positive form in the barrier layer 6 the desired words or symbology may be printed on the barrier layer 6. The printed portion 8 of the barrier layer is selected to block the transmission of emitted light from the photoluminescent material. In the final product the symbology or wording will appear as a dark area on an illuminated background in the sign in a low light level scenario as illustrated in FIG. 3. In some embodiments the barrier layer may comprise a black or red print on a film. The print may be the wording or symbology. The black or red print may be a layer with the words or symbology in negative.

Where the symbology or words are provided in negative form in the barrier layer, the symbology or wording 8 will appear as an illuminated area on a dark background in the emergency sign in a low light level scenario as illustrated in FIG. 4. In some embodiments a print may be made of an opaque material over a surface area of the barrier layer with unprinted areas on the layer forming the words of symbology. In other arrangements the words or symbology could be formed by cut out(s) in an opaque film. The words or symbology may be provided by an aperture in the film or, in another embodiment, by a portion of the layer where there is no printing on the photoluminescent material.

A mask layer 14 is provided between the barrier layer 6 and the print layer 10. In this embodiment the mask layer can comprise a film. The mask layer film may be a colored film. More preferably the mask layer 14 is a film on which a coating of ink has been printed. In another preferred embodiment the mask layer comprises a layer of printed ink or other coating applied over the barrier layer.

The mask layer 14 is arranged to be a neutral color. Preferably the mask layer has a homogenous color. The color of the mask layer 14 can be selected to provide an even and homogenous background to the printed layer 10 which at least partially obscures and neutralizes the contrast in the barrier layer 6 between an aperture and the printed barrier layer.

In some embodiments, the mask layer 14 has a homogenous color. In some embodiments, the mask layer 14 is white. In other embodiments another neutral color may be selected. The mask layer 14 provides an even tone as a background for the print layer. In some embodiments, the print layer 10 can be provided on a layer of film and superposed on the mask layer. In other embodiments a printed pattern may be printed directly onto the mask layer to provide a print layer 10.

It is desirable that the mask layer 14 is transparent or at least partially transparent, to wavelengths in the first range and in the second range. The first range allows light at wavelengths that are absorbed by the photoluminescent material to charge the photoluminescent materials. The second range allows emitted wavelengths to pass through the mask layer.

Desirably the mask layer 14 is provided over substantially all of the surface area of the sign.

Figure 5:
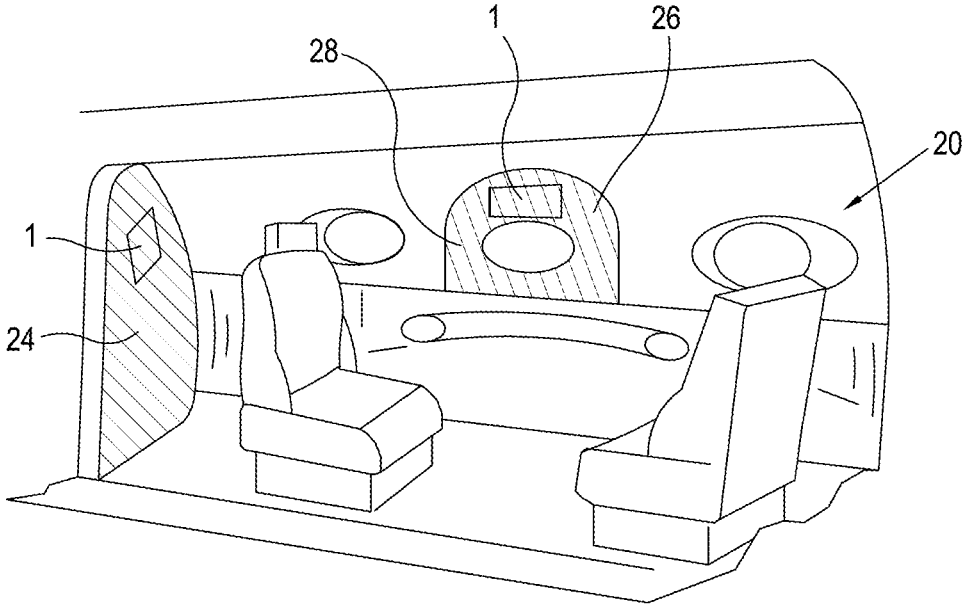
FIG. 5 is a view of a cabin of an aircraft, in accordance with an exemplary embodiment.

As illustrated in FIG. 5, it is intended that the sign 1 will be utilized in a cabin 20 in an aircraft 22. The sign 1 may be adapted to be secured to a wall 24 in the cabin 20 or to be secured to a fitting 26 in the cabin 20 of the aircraft 22. Typically a wall 24 of an aircraft has a color or a pattern. The wall 24 or fitting 26 may have a plain color or may have a pattern such as a wood effect.

Figure 6:
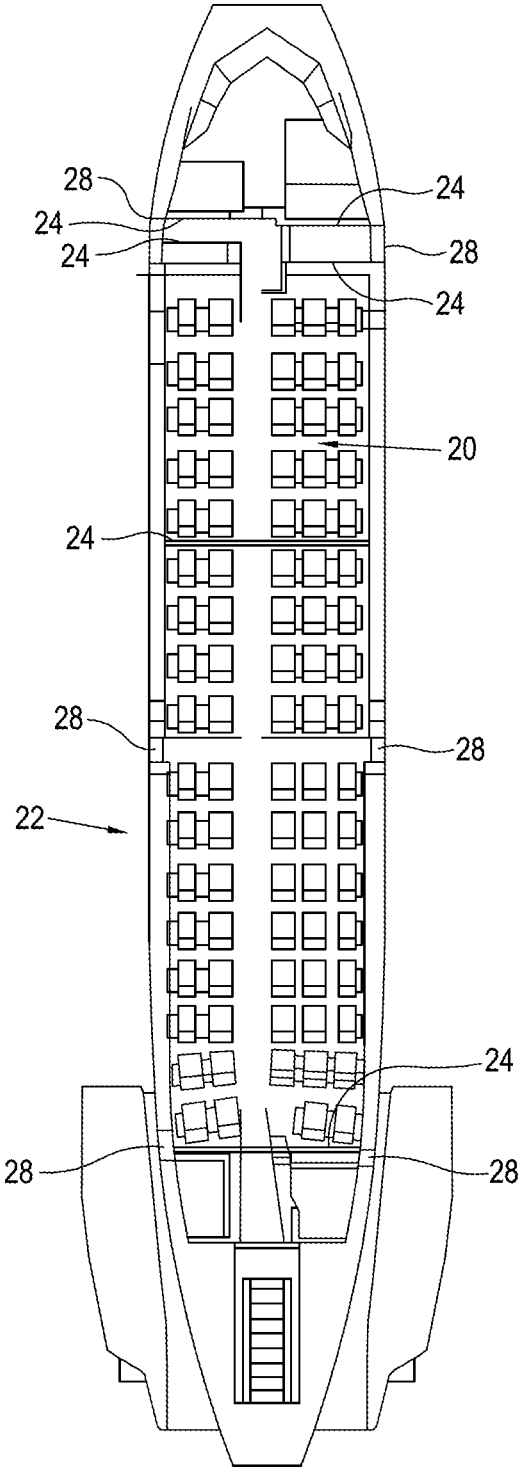
FIG. 6 is a schematic view of an aircraft, in accordance with an exemplary embodiment.

It will be appreciated that the sign 1 may be indicative of the location of an emergency exit 28 or may be informational. FIG. 6 is a schematic indication of an aircraft in accordance with an exemplary embodiment in which the location of emergency exits 28 are indicated by location of signs 1 on walls of the cabin 20 and internal walls 24 of the cabin 20.

Figure 2:
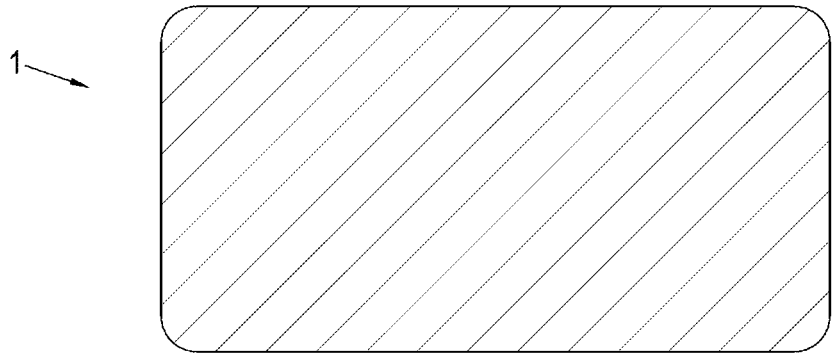
FIG. 2 is a view of the sign of FIG. 1 in normal ambient lighting conditions, in accordance with an exemplary embodiment.

In a normal lighting scenario, the ambient light is reflected by the print layer which matches that of a surrounding surface of a wall or fitting on which the sign is mounted as illustrated in FIG. 2. Emissions from the photoluminescent material are relatively much lower in intensity than the reflected light and are not perceived by passengers or crew. Consequently, the sign is perceived as being a part of the surrounding surface and the symbology or words in the barrier layer are not visible to passenger or crew in a normal ambient light scenario.

The print layer is printed with at least one of a color or a pattern to match the wall or fitting to which the sign is intended to be secured. It is intended that the printed pattern or color is such that in a normal ambient light level the location of the sign is not identifiable and the wording or symbology is not visible. The sign blends into the surface on which it is mounted in normal ambient lighting conditions.

In some embodiments, the sign is provided with a protective layer which is arranged to cover at least part of the print layer. The protective layer is desirably arranged to cover substantially the entire print layer and to protect sign from wear and tear. The protective layer may have a finish selected from matte, gloss or antiglare.

The photoluminescent material in the base layer exhibits persistent luminescence. Typically the photoluminescent material comprises a strontium aluminate. In a preferred embodiment the photoluminescent material may be selected from blue emitting $Sr_4Al_{14}O_{25}Eu$, Dy and green emitting $SrAlO_4Eu$, Dy. The photoluminescent material is excited, or charged, by electromagnetic wavelengths in the first range. The excitation wavelengths in the first range may be from 250 nm to 470 nm.

In some embodiments the photoluminescent material emits electromagnetic wavelengths in the range from 400 to 800 nm. The second range may from 400 nm to 600 nm or from 450 nm to 500 nm. The photoluminescent material may be emitting wavelengths in the second range that are blue and may be substantially 490 nm. In other embodiments, the second range may be from 450 nm to 700 nm or from 500 nm to 600 nm or more preferably from 500 nm to 550 nm. In some embodiments, the photoluminescent material may be emitting wavelengths second range that are green and may be arranged to be around 520 nm.

An important aspect of some embodiments is that in a low ambient light scenario light emitted from the photoluminescent material passes through a portion of the barrier layer, the mask layer and the print layer and the emergency signage or symbols is visible to the passengers and crew of the vehicle. Typically, a low light scenario is one in which normal electric lighting in the vehicle has failed and the cabin is dark. It will be appreciated that the light emitted can be in the range to which the human eye is sensitive in scotopic vision. A level or intensity of light output from the photoluminescent material may then be lower than would be needed if the light output is in a different range of wavelengths.

In a normal lighting scenario, the ambient light is reflected by the print layer which matches that of a surrounding surface of a wall or fitting on which the sign is mounted. Emissions from the photoluminescent material are relatively much lower than the reflected light and are not perceived by passengers or crew. Consequently, the sign is perceived as being a part of the surrounding surface, and the symbology or words in the barrier layer are not visible to passenger or crew in a normal ambient light scenario.

As a result, the emergency sign is not visible in normal operating light level conditions but becomes visible in an emergency scenario in which electrical lighting has failed or is obscured. Safety requirements for providing guidance to passengers and crew are met by the sign in an emergency scenario but passenger experience is not reduced by the visibility of emergency signage in normal use. Additionally the aesthetic appearance of a cabin is not reduced by the intrusion of emergency signage in normal use but safety requirements are met in the event of an emergency.

According to an exemplary embodiment, the emergency sign is used in an aircraft or aircraft cabin.

It will be appreciated that the product must meet aerospace requirements. These include DO-160 for environmental requirements, such as the effects of temperature, altitude, humidity, shock and crash safety, vibration, water and fluid susceptibility, flammability etc. Signs must meet the requirements of CS/FAR25.853 with regard to flammability resistance.

The luminance of the sign must also meet the requirements of CS 25.812 and CS23.2315 for large aeroplanes or CS 29.812 for large rotorcraft for safety critical signage, particularly where the signs are used for emergency exit signs. In small aircraft or rotorcraft the sign may need to meet the requirements of CS27.805 and CS27.807.

It will be appreciated that the sign may be mounted in a portion of a wall of the aircraft cabin. In other embodiments, the cabin may be provided with a fitting and the sign may be mounted in a portion of the fitting in the cabin. The sign is provided with a pattern or color that matches the portion of the wall or fitting on which the sign is to be mounted or secured.

What is claimed is:

1. An aircraft comprising a cabin having at least one emergency sign, the emergency sign comprising:

a base layer comprising a photoluminescent material arranged to be charged by electromagnetic wavelengths in a first range and arranged to emit electromagnetic emissions in a second range;

a barrier layer adjacent to the base layer, wherein the barrier layer comprises symbology or words printed in positive or negative form, the printed symbology or words being configured to block the transmission of light in the second range;

a print layer, the print layer comprising at least one of a printed color or a printed pattern and wherein the print layer is above the barrier layer and on a side of the barrier layer remote from the base layer, the print layer being at least semi-transparent to wavelengths in the first range and the second range; and a mask layer provided between the barrier layer and the print layer, the mask layer being configured to provide an even and homogenous background to the printed layer, at least partially neutralizing the color contrast between the printed and unprinted portions of the barrier layer.

2. The aircraft of claim 1, wherein the emergency sign is mounted in a portion of a wall or fitting in the cabin and wherein the print layer of the emergency sign has a printed pattern matching a surface of the wall or fitting.

3. The aircraft of claim 1, wherein the symbology or words are in negative form.

4. The aircraft of claim 3, wherein the symbology or words are visible in a low ambient light level and wherein the printed color or the printed pattern on the print layer is visible in a high ambient light level.

5. An aircraft emergency sign comprising:

a base layer comprising a photoluminescent material arranged to be charged by electromagnetic wavelengths in a first range and arranged to emit electromagnetic emissions in a second range;

a barrier layer adjacent to the base layer, wherein the barrier layer comprises symbology or words printed in positive or negative form, the printed symbology or words being configured to block the transmission of light in the second range;

a print layer, the print layer comprising at least one of a printed color or a printed pattern, wherein the print layer is above the barrier layer and on a side of the barrier layer remote from the base layer, and wherein the print layer is at least semi-transparent to wavelengths in the first range and the second range; and a mask layer provided between the barrier layer and the print layer, the mask layer being configured to provide an even and homogenous background to the printed layer, at least partially neutralizing the color contrast between the printed and unprinted portions of the barrier layer.

6. The aircraft emergency sign of claim 5, wherein the mask layer is arranged over substantially all of a surface area of the emergency sign.

7. The aircraft emergency sign of claim 5, wherein the mask layer has a neutral color.

8. The aircraft emergency sign of claim 5 further comprising a protective layer and wherein the protective layer is a top layer.

9. The aircraft emergency sign of claim 5, wherein the photoluminescent material comprises a strontium aluminate.

10. The aircraft emergency sign of claim 5, wherein the photoluminescent material is blue emitting $Sr_4Al1_4O_{25}Eu$, Dy.

11. The aircraft emergency sign of claim 5, wherein the photoluminescent material is green emitting $SrAlO_4Eu$, Dy.

12. The aircraft emergency sign of claim 5, wherein the first range is from 250 nm to 470 nm.

13. The aircraft emergency sign of claim 5, wherein the second range is from 450 nm to 500 nm.

14. The aircraft emergency sign of claim 5, wherein the second range is from 501 nm to 540 nm.

15. An aircraft comprising a cabin having at least one emergency sign, the emergency sign being mounted in a portion of a wall or fitting in the cabin, and comprising:

a base layer comprising a photoluminescent material arranged to be charged by electromagnetic wavelengths in a first range and arranged to emit electromagnetic emissions in a second range;

a barrier layer; and a print layer, the print layer being printed with at least one of a color or a pattern and wherein the print layer is above the barrier layer and on a side remote from the base layer, the print layer being at least semi-transparent to wavelengths in the first range and the second range, and wherein the print layer of the emergency sign has a pattern matching a surface of the wall or fitting, the emergency sign further comprising a mask layer provided between the barrier layer and the print layer.

* * * * *